United States Patent [19]

Haltof

[11] Patent Number: 4,571,887

[45] Date of Patent: Feb. 25, 1986

[54] AUTOMATIC FRICTION SASH HOLDER

[75] Inventor: Garry P. Haltof, Rochester, N.Y.

[73] Assignee: Caldwell Manufacturing Company, Rochester, N.Y.

[21] Appl. No.: 593,397

[22] Filed: Mar. 26, 1984

[51] Int. Cl.[4] ..... E05F 3/00

[52] U.S. Cl. ..... 49/429; 49/415; 16/197

[58] Field of Search ..... 49/429–431, 49/433–435, 414, 415, 417, 445, 421, 423, 444, 437, 438, 442, 457, 446; 16/193, 197

[56] References Cited

U.S. PATENT DOCUMENTS

| | | | |
|---|---|---|---|
| 2,352,171 | 6/1944 | Anfinson . | |
| 2,651,535 | 9/1953 | Padjen . | |
| 2,913,781 | 11/1959 | Czubachowski . | |
| 3,007,194 | 11/1961 | Griswold . | |
| 3,407,434 | 10/1968 | Scott . | |
| 3,466,806 | 9/1969 | Teggelaar et al. . | |
| 3,499,248 | 3/1970 | Baer | 49/430 |
| 3,501,867 | 3/1970 | Scott . | |
| 3,991,521 | 11/1976 | Crosby . | |
| 4,190,930 | 3/1980 | Prosser | 49/445 X |

FOREIGN PATENT DOCUMENTS

| | | | |
|---|---|---|---|
| 249645 | 2/1964 | Australia | 49/430 |
| 723420 | 12/1965 | Canada | 49/430 |

*Primary Examiner*—Kenneth Downey

*Attorney, Agent, or Firm*—Stonebraker, Shepard & Stephens

[57] ABSTRACT

A sash holder 10 automatically produces sash-holding friction in a resin jamb liner 12 in which the sash 11 runs. Jamb liner 12 has a track 20 in the sash plow region of each sash run 16 and 17, and track 20 is formed within parallel L-shaped edge guides 21. Sash holder 10 includes an upper component 25 connected to a balance spring 13 and a lower component 26 supporting sash 11 in its sash plow region. Overlapping surfaces 39 and 40 of components 25 and 26 form an interferring wedge that operates when the components move vertically to each other in response to spring force pulling upward against the sash weight. The interferring wedge can be arranged in several ways for pressing runners 27 and 28 against track guides 21 to produce sash-holding friction as a function of the vertical extent of the vertical movement of the overlapping surfaces.

39 Claims, 9 Drawing Figures

AUTOMATIC FRICTION SASH HOLDER

BACKGROUND

A window sash running in a resin jamb liner and counterbalanced by springs needs some friction to hold a set position. Without friction, the springs would balance the sash in a position about half open; but friction between the sash and the jamb liner can hold the sash anywhere from closed to wide open. A larger and heavier sash with stronger counterbalance springs needs more friction to hold a set position. Too much friction, however, makes the sash hard to move.

The window art contains many suggestions addressed to the long-standing problem of suitable friction for a spring-balanced, wooden sash; but the proposed solutions all leave several shortfalls. Most friction devices variably expand in the limited space between the jamb liner and the sash stile; but this can deform a resin jamb liner, causing a poor appearance and a possible air leak. Some friction devices are not adjustable so that they have to be made in several sizes for different size windows. Other friction devices can be adjusted only by taking the window apart; and many friction devices are complex, expensive, short-lived, or unreliable.

My sash holder provides sash-holding friction that automatically varies with different sash weights and counterbalance spring forces. My holder is also economical to manufacture, easy to install, and rugged and serviceable. It uses few components, requires no attachment to the sash, and adapts automatically to both upper and lower sashes so as to be practically universal.

SUMMARY OF THE INVENTION

My automatic friction sash holder is usable with a sash running in a resin jamb liner having a track in a sash plow region of the sash run of the jamb liner. The track is formed within a pair of parallel guides that are L-shaped in cross section and oriented to project from the sash run to form lateral sides of the track and to extend toward each other from the track sides to form interlocks. The sash holder includes upper and lower components each molded of resin material with the upper component having a balance spring connection and the lower component having a platform element arranged to span the sash plow region of the lower corner of the sash. These components have upper and lower runners with opposite lateral edges disposed for running along the lateral sides of the track where the interlocks confine them for vertical movement. The components also have overlapping surfaces that are shaped to form an interferring wedge that operates when the components move vertically relative to each other in response to spring force pulling upward against sash weight. The interferring wedge presses the runners against the guides to provide sash-holding friction as a function of the extent of the vertical movement of the overlapping surfaces. Preferably a friction shoe on one of the components is arranged so that the interferring wedge presses the shoe against the track and presses the runners against the interlocks.

DRAWINGS

DETAILED DESCRIPTION

Figure 1:
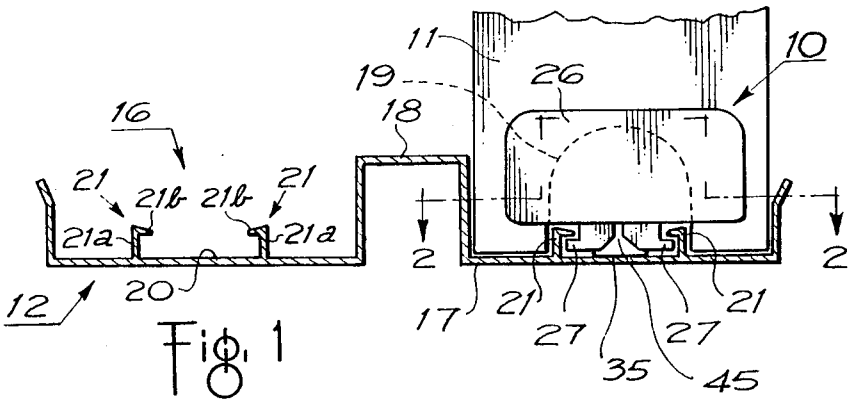
FIG. 1 is a fragmentary and partially sectioned bottom view of a sash held in a jamb liner with a preferred embodiment of my automatic friction sash holder.
Figure 3:
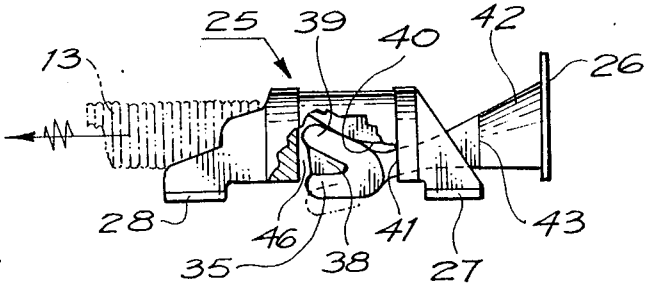
FIG. 3 is a partially cutaway, side elevational view of the holder of FIG. 2.
Figure 2:
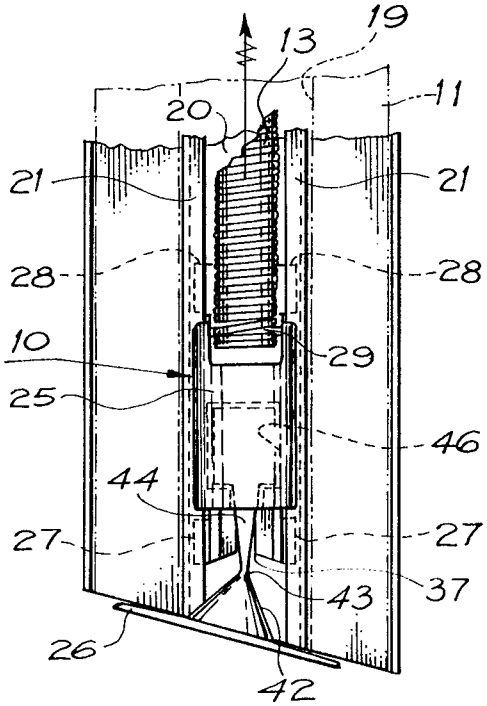
FIG. 2 is a cross-sectional view of the sash and holder of FIG. 1, taken along the line 2—2 thereof.

The environment in which my automatic friction sash holder works is best shown in FIGS. 1–3. These views illustrate one preferred embodiment of my holder 10, which provides friction suitable for holding sash 11 at any vertical position in its run within jamb liner 12.

Extruded resin jamb liner 12 extends vertically within a window frame and includes a pair of sash runs 16 and 17 separated by a parting bead 18. For illustrative purposes in FIG. 1, lower sash 11 is mounted in sash run 17, and upper sash run 16 is empty. Each sash run has a track 20 in a sash plow region, where the sash stile has a plow groove 19 that clears a balance spring and a spring cover (not shown) in the upper half of the sash run.

Tracks 20 have parallel edge guides 21 that are L-shaped in cross section to project from the sash run and extend toward each other along opposite sides of track 20. Guides 21 have parallel elements **21*a* forming lateral sides of track 20 and interlock elements 21*b* extending toward each other to confine components to vertical movement on track 20** as explained below.

Holder 10 includes a carriage 25 that fits within plow groove 19 in the stile of sash 11 and a platform 26 that spans plow 19 at a lower corner of sash 11. Sash 11 rests its weight on platforms 26 at opposite lower corners of sash 11. A balance spring 13, that can have several different forms, connects to an upper region of carriage 25 and pulls upward on carriage 25 and platform 26 to balance sash 11.

Carriage 25 has a pair of vertically spaced runners 27 and 28 that run up and down track 20 with sash 11. The lateral edges of runners 27 and 28 move along lateral sides **21*a* and are confined to vertical movement along track 20 by interlocks 21*b***.

Platform 26 connects to carriage 25 in a way that automatically provides friction for holding sash 11 in any set position. An arm having a lower portion 42, a bendable region 43, and an upper portion 44 connects platform 26 to a wedge 39 that includes a friction shoe 35 and a web 38 bracing wedge 39 away from friction shoe 35. Wedge 39 overlaps with a sloping surface 40 on carriage 25 for an interferring wedge effect so that vertical relative movement between wedge 39 and sloping surface 40 presses friction shoe 35 against track 20.

The same movement that presses friction shoe 35 against track 20 also presses carriage 25 away from track 20. This urges carriage runners 27 and 28 against interlocks **21*b*. The total friction from shoe 35 pressing against track 20 and runners 27 and 28 pressing against interlocks 21*b* combines to hold sash 11** in any set position. The total friction is also proportional to the sash weight and counterbalance spring force. In other words, the friction force applied by the interferring wedge movement automatically increases and decreases with sash weight and spring force.

Overlapping surfaces of wedge 39 and incline 40 can have many different shapes. Surface 40 is shown as curved, but could also be linear and could have different angles. Element 39 need not be wedge-shaped and could be a cylinder, shoe, or other shape that causes movement toward and away from track 20 as its vertical position varies relative to surface 40. Carriage 25 has a cavity 46 between inclined surface 40 and track 20, and wedge 39 and friction shoe 35 can move vertically and laterally to a limited extent within cavity 46. A gap 37 in lower runner 27 receives the arm connecting platform 26 and wedge 39 so that narrow arm region 43 can be pressed through gap 37 in lower runner 27 to move wedge 39 into cavity 46.

Stop surface 41 on carriage 25 is arranged to engage the lower edge of wedge 39 to limit the vertical extent of the interferring wedge movement and thus limit the maximum friction. Stop surface 41 is positioned so that the maximum friction is adequate to hold the heaviest sash 11 in its lowermost or uppermost positions. By providing an upper limit on the maximum friction, stop surface 41 allows sash 11 to be moved downward from a set position by a force that overcomes the maximum friction.

The thin, bendable region 43 in the arm between platform 26 and wedge 39 allows platform 26 to be angled from a perpendicular to track 20 as best shown in FIG. 2. Platform 26 can then tilt either way to fit the approximately 14° incline that is standard for the bottom rail of lower sash 11, and platform 26 can rest perpendicular to track 20 when supporting an upper sash.

Platform 26 does not need to be fastened to the bottom of a sash. When a sash is raised, its weight is lifted from platforms 26 so that counterbalance springs 13 raise holders 10 and move platforms 26 upward along with the sash. When in a set position or moving downward, the weight of a sash rests on platform 26 without requiring any fastening.

Figure 4:
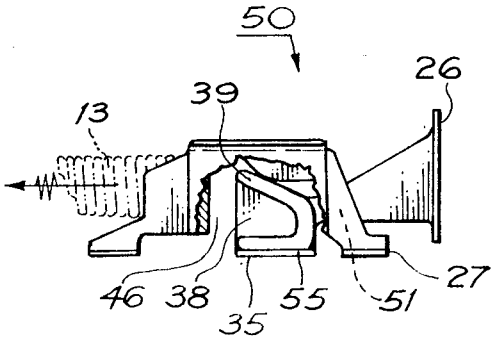
FIG. 4 is a partially cutaway, side elevational view similar to the view of FIG. 3 showing a preferred alternative of my holder.
Figure 5:
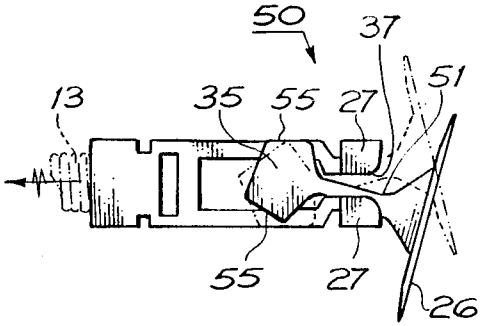
FIG. 5 is a view of the track-engaging side of the holder of FIG. 4.

Another preferred holder 50 of FIGS. 4 and 5 is similar in operation to holder 10. The differences involve the way holder 50 accommodates oblique support angles for platform 26.

Instead of having a thin, bendable region 43 in an arm supporting platform 26 (as shown in FIG. 2), arm 51 extending between platform 26 and wedge 39 of holder 50 is made thicker and less bendable. The desired angular movement for platform 26 is accomplished by pivoting the whole lower component including platform 26, arm 51, wedge 39, and friction shoe 35. Friction shoe 35 has angled lateral edges 55 to accommodate such pivoting motion and to fit under interlocks **21*b*. Cavity 46 and wedge 39 are also shaped to accommodate such pivoting motion, and lower runner 27 has a wider central gap 37 to receive thicker arm 51**.

Figure 6:
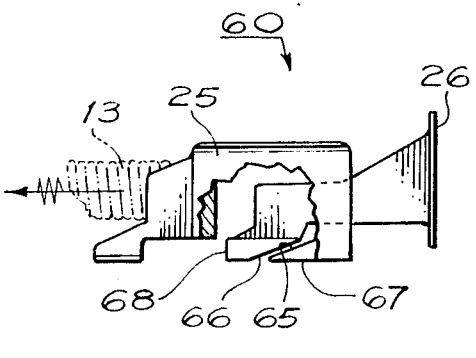
FIG. 6 is a partially cutaway, side elevational view of another preferred alternative of my holder.
Figure 7:
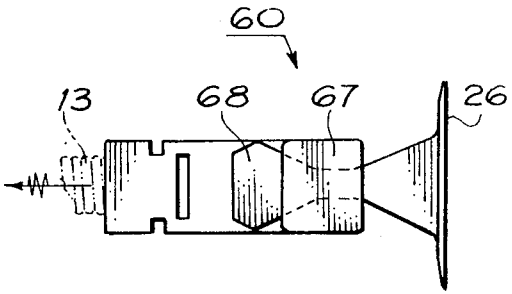
FIG. 7 is a view of the track-engaging side of the holder of FIG. 6.

Another holder 60 as shown in FIGS. 6 and 7 has a different form of interferring wedge producing automatic holding friction in a different way. Carriage 25 has a lower runner 67 with an inclined surface 65 overlapping a confronting inclined surface 66 on an upper runner 68 formed on the lower component supporting platform 26.

Spring force and sash weight causing vertical relative movement between carriage 25 and platform 26 make upper runner 68 slide downward relative to lower runner 67. This presses lower runner 67 against track 20 and presses upper runner 68 against interlocks **21*b* to provide holding friction. Interlocks 21*b* are preferably spaced a little farther from track 20 than for the embodiments of FIGS. 1-5 to accommodate the overlapping interference wedge surfaces 65 and 66 and the lateral spreading motion that occurs when runners 67 and 68** override each other.

Figure 8:
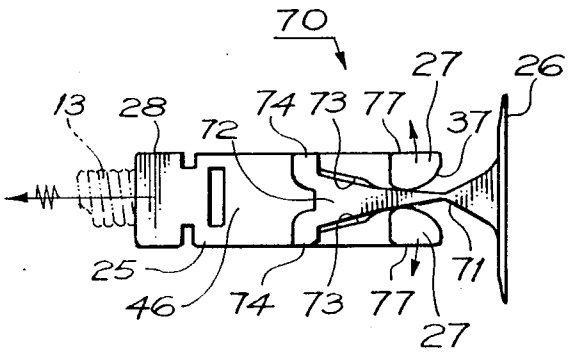
FIGS. 8 and 9 are views of the track-engaging sides of two other preferred embodiments of holders.

Overlapping interference wedge surfaces can also be arranged for spreading the lateral edges of a runner against track sides **21*a* to provide an automatically adjustable holding friction as shown in the alternative of FIG. 8. The lower runner 27 of carriage 25, which is divided by a gap 37 to receive the arm 71 connecting platform 26 to a wedge 72, has its lateral edges 77 spread apart as indicated by the arrows when wedge 72 moves downward against inclined carriage surfaces 73. This presses lateral edges 77 of runner 27 against the lateral sides 21*a* of track 20 for a holding friction that is automatically set as a function of the relative vertical motion between the upper and lower components of holder 70. An additional pair of runners 74 on wedge 72 fit under interlocks 21*b* to help hold wedge 72 in place within cavity 46 in carriage 25**.

Figure 9:
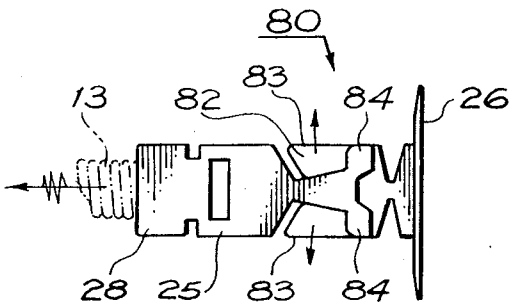

The alternative holder 80 of FIG. 9 reverses the runner wedging action between upper component 25 and lower component 26, compared to the alternative of FIG. 8. A wedge 81 integral with upper component 25 is straddled by a spreadable runner 82 that is integral with platform 26 so that vertical relative motion between the components forces the lateral edges 83 of runner 82 against the sides **21*a* of track 20. An extra pair of runners 84 fitting under interlocks 21*b* helps guide upper component 25 along track 20**.

I claim:

1. A sash holder for automatically varying the vertical sliding friction of a sash running in a sash run having a vertical guide wall extending from said sash run into a plow region of a stile of a sash, said holder comprising:

a. an upper component having a balance spring connection;

b. a lower component having a platform for said sash;

c. said components having runners disposed for frictionally sliding along said guide wall as said sash slides vertically in said sash run;

d. said components having overlapping surfaces shaped to form an interferring wedge;

e. said overlapping surfaces of said interferring wedge being arranged to move vertically relative to each other in response to force of a spring pulling upward on said spring connection against the weight of said sash resting on said platform; and f. said vertical movement of said overlapping surfaces of said interferring wedge causing lateral movement of said runners against said guide wall to vary the pressure of said runners against said guide wall and thereby vary said vertical sash sliding friction automatically as a function of the extent of said vertical movement of said overlapping surfaces.

2. The holder of claim 1 wherein said upper and lower components are both arranged in said plow region of said sash stile.

3. The holder of claim 1 including means for limiting said vertical movement of said interferring wedge to limit a maximum frictional grip of said runners on said guide wall.

4. The holder of claim 1 wherein said lower component is arranged to allow said platform to incline about 14° from perpendicular to said guide wall to fit a lower rail of a bottom sash.

5. The holder of claim 1 including a pair of said guide walls arranged parallel to each other in said plow region of said sash stile and wherein said runners frictionally engage both of said guide walls.

6. The holder of claim 5 wherein said guide walls are L-shaped in cross section and extend from said sash run along opposite sides of said plow region and extend inward toward each other.

7. The holder of claim 6 wherein said runners engage said inward extending portions of said guide walls.

8. The holder of claim 7 wherein said upper and lower components are both arranged in said plow region of said sash stile.

9. The holder of claim 7 including means for limiting said vertical movement of said interferring wedge to limit a maximum frictional grip of said runners on said guide wall.

10. The holder of claim 7 wherein said lower component is arranged to allow said platform to incline about 14° from perpendicular to said guide wall to fit a lower rail of a bottom sash.

11. In a sash holder for a sash running in a sash run having a vertical guide wall extending from said sash run into a plow region of a stile of said sash, the improvement comprising:

a. a pair of components controlling lateral motion of runners disposed for frictionally sliding along said guide wall as said sash slides vertically in said sash run, one of said components having a balance spring connection and the other of said components having a platform for said sash;

b. said components having an interferring wedge formed as overlapping surfaces arranged to move vertically relative to each other in response to force of a spring pulling upward on said spring connection against the weight of said sash resting on said platform; and c. said runners being moved laterally against said guide wall in response to said vertical movement of said overlapping surfaces of said interferring wedge for variably pressing said runners against said guide wall to vary the vertical sliding friction of said sash automatically as a function of the extent of said vertical movement of said overlapping surfaces.

12. The improvement of claim 11 wherein said pair of components are arranged in said plow region of said sash stile.

13. The improvement of claim 11 including means for limiting said vertical movement of said interferring wedge to establish a maximum pressure of said runners against said guide wall.

14. The improvement of claim 11 wherein said platform is arranged to be inclined about 14° from perpendicular to said guide wall to fit a lower rail of a bottom sash.

15. The improvement of claim 11 including a pair of said guide walls arranged parallel to each other in said plow region of said sash stile and wherein said runners frictionally engage both of said guide walls.

16. The improvement of claim 15 wherein said guide walls are L-shaped in cross section and extend from said sash run along opposite sides of said plow region and extend inward toward each other.

17. The improvement of claim 16 wherein said runners engage said inward extending portions of said guide walls.

18. The improvement of claim 17 wherein said pair of components are arranged in said plow region of said sash stile.

19. The improvement of claim 17 including means for limiting said vertical movement of said interferring wedge to establish a maximum pressure of said runners against said guide wall.

20. The improvement of claim 17 wherein said platform is arranged to be inclined about 14° from perpendicular to said guide wall to fit a lower rail of a bottom sash.

21. A method of automatically adjusting the friction of a sash holder sliding along a guide wall extending from a sash run into a plow region of a stile of a sash supported by said holder, said method comprising:

a. arranging an interferring wedge between a pair of components controlling runners that frictionally slide along said guide wall, one of said components having a balance spring connection, and the other of said components having a sash platform; and b. using vertical motion of said interferring wedge in response to force of a spring pulling upward on said spring connection against the weight of said sash resting on said platform to move said runners laterally for varying the pressure of the frictional engagement of said runners with said guide wall to vary the vertical sliding friction of said sash holder automatically as a function of the extent of said vertical movement of said interferring wedge.

22. The method of claim 21 including limiting the vertical motion of said interferring wedge to limit the maximum frictional engagement of said runners with said guide wall.

23. The method of claim 21 including inclining said platform from perpendicular to said guide wall to fit a lower rail of a bottom sash.

24. The method of claim 21 including arranging said components within said plow region of said sash stile.

25. The method of claim 21 including using a pair of parallel guide walls along opposite sides of said plow region of said sash stile and arranging said runners for frictionally engaging both of said guide walls.

26. The method of claim 25 including forming said guide walls with L-shaped cross sections so that said guide walls extend away from said sash run and inward toward each other.

27. The method of claim 26 including engaging said inward extending portions of said guide walls with said runners.

28. The method of claim 27 including limiting the vertical motion of said interferring wedge to limit the maximum frictional engagement of said runners with said guide walls.

29. The method of claim 27 including inclining said platform from perpendicular to said guide wall to fit a lower rail of a bottom sash.

30. The method of claim 27 including arranging said components within said plow region of said sash stile.

31. A method of automatically adjusting the frictional grip of a sash holder on a guide wall extending from a sash run into a plow region of a stile of a sash supported by said sash holder, said method comprising:

a. forming said sash holder with runners that slide along said guide wall and are movable laterally to vary the pressure of said runners against said guide wall and thereby vary the frictional grip of said runners resisting vertical movement along said guide wall; and b. deriving lateral gripping motion for said runners from a vertically movable interferring wedge between one component of said sash holder connected to a balance spring and another component of said sash holder having a platform supporting said sash so that both the vertical movement of said interferring wedge and the lateral gripping motion of said runners are functions of spring force pulling upward on said one component against the weight of said sash resting on said platform.

32. The method of claim 31 including using a pair of said guide walls parallel to each other along opposite edges of said plow region of said sash stile so that said runners slide along and adjustably grip both of said guide walls.

33. The method of claim 32 including forming said guide walls with L-shaped cross sections so that said guide walls extend away from said sash run and inward toward each other.

34. The method of claim 33 including engaging said inward extending portions of said guide walls with said runners.

35. An automatic friction system for a sash holder for a sash running in a sash run having a guide wall extending from said sash run into a plow region of a stile of said sash, said friction system comprising:

a. said sash holder having a pair of runners movable laterally into an adjustable frictional grip against said guide wall;

b. said sash holder including an upper component connected to a balance spring and a lower component having a sash platform;

c. said upper and lower components forming an interferring wedge movable vertically as a function of the force of said spring pulling upward against the weight of said sash on said platform; and d. said vertical motion of said interferring wedge having a lateral component applied to said runners for varying the pressure of said adjustable frictional grip of said runners on said guide wall and thereby varying the vertical motion resistance of said sash holder.

36. The system of claim 35 including a pair of said guide walls arranged parallel to each other on opposite sides of said plow region of said sash stile, said runners being arranged for frictionally gripping both of said guide walls.

37. The system of claim 36 wherein said guide walls are L-shaped in cross section to extend away from said sash run and inward toward each other.

38. The system of claim 37 wherein said runners engage said inward extending portions of said guide walls.

39. The system of claim 38 wherein said lower component is arranged for inclining said platform about 14° from perpendicular to said guide wall to fit a lower rail of a bottom sash.

* * * * *